US005109908A

United States Patent [19]

Chen

[11] Patent Number: 5,109,908

[45] Date of Patent: May 5, 1992

[54] CURTAIN ASSEMBLY

[76] Inventor: Cheng-Hsiang Chen, No. 228, Sec. 2, Chung-Te Rd., Pei-Tun Dist., Taichung City, Taiwan

[21] Appl. No.: 604,975

[22] Filed: Oct. 26, 1990

[51] Int. Cl.[5] ..... E06B 9/06

[52] U.S. Cl. ..... 160/84.1; 160/330; 160/178.2

[58] Field of Search ..... 160/330, 84.1, 340, 160/173, 178.2, 168.1

[56] References Cited

U.S. PATENT DOCUMENTS

| | | | |
|---|---|---|---|
| 2,310,014 | 2/1943 | Apfel | 160/84.1 X |
| 2,357,911 | 9/1944 | Schaefer | 160/178.2 X |
| 3,777,800 | 12/1973 | Susoev | 160/84.1 |
| 3,952,788 | 4/1976 | Scholer | 160/84.1 |
| 4,501,311 | 2/1985 | Folland | 160/84.1 X |
| 4,877,075 | 10/1989 | Markowitz | 160/84.1 |
| 4,921,032 | 5/1990 | May | 160/84.1 |
| 4,928,743 | 5/1990 | Wojtysiak | 160/84.1 |

FOREIGN PATENT DOCUMENTS

| | | | |
|---|---|---|---|
| 7408719 | 12/1975 | Netherlands | 160/178.2 |

*Primary Examiner*—Blair M. Johnson
*Attorney, Agent, or Firm*—Christensen, O'Connor, Johnson & Kindness

[57] ABSTRACT

A curtain assembly in which vertical sections of a curtain may be individually adjusted is provided with a curtain having a plurality of attached strings extending along the height of the curtain. Each string defines a boundary of at least one corresponding vertical section of the curtain. The curtain hangs from an elongate support member of rectangular cross section having a plurality of first rollers mounted therein. Each of the first rollers operatively cooperates with a corresponding one of the strings. A second roller mounted adjacent an end of the support member operatively cooperates with all of the strings. A plurality of string control members, each operatively connected with a corresponding string, are used for holding and releasing the strings. By selectively operating the corresponding strings, a user can adjust individual vertical sections of the curtain such that the curtain can be wholly or partially raised or lowered as desired.

2 Claims, 7 Drawing Sheets

CURTAIN ASSEMBLY

BACKGROUND OF THE INVENTION

The present invention relates to a curtain assembly and, more particularly, to an improved curtain assembly having a means to raise and/or lower the curtain partially or wholly, according to the user's wishes.

Curtains are well known in the art. They are used to hang on doors, windows, bathrooms and drawing rooms for decorative purposes, to block scorching sunlight, or to provide privacy. FIG. 1 shows a roll-up and roll down curtain assembly of the prior art. Accordingly, it includes an elongated frame (1) attached to the upper portion of a window frame. A plurality of first rollers (2) are separately disposed in the base portion of the elongated frame, each spaced a predetermined distance from the next. A pair of second rollers (3) are provided on either sides, above the first rollers, in the elongated frame.

The curtain C is generally like a conventional curtain, and has a length "L" longer than that of the elongated frame "W", and a plurality of strings (8) extending from the bottom to the top of the curtain. Each of the strings (8) respectively passes over a corresponding first roller (2) and then encircles a second roller (3) and is connected to a first regulator (5). A control cord (7) passes through regulators (5) and connects all the strings. The curtain C of such invention can only be rolled up to a height of "d" (wherein "d" is smaller than "W") since the plurality of strings (8) are stopped by the regulators (5) of the elongated frame.

SUMMARY OF THE INVENTION

It is therefore the main object of the present invention to provide a curtain assembly, wherein the curtain has a plurality of vertical portions, which can be rolled up and/or lowered individually or together, according to the user's wishes.

According to the present invention, the curtain assembly includes: a frame, a plurality of first rollers, a second roller, a plurality of strings, a string controlled member and a curtain.

The frame is an elongated, generally rectangular member having a top wall, a bottom wall, two side walls and a guide path defined by the top, bottom end, two side walls. A plurality of first rollers are disposed in the guide path, each being spaced apart from one another at a predetermined distance. A second roller is also disposed in the guide path of the elongated member adjacent to one end thereof. The bottom wall of the elongated frame has a slit formed therealong.

There are the same number of strings as there are first rollers. One end of each string is connected to a curtain, and the other end passes through the slit of the bottom wall of the elongated member and over the corresponding first roller, over the second roller, and extends out of the frame. The curtain can be rolled up and/or lowered as a whole or partially according to the wishes of a user, by pulling the exposed ends of the strings together or separately.

The string control member is generally fixed to a wall near the window. It includes the same number of plate members as there are first rollers. Each plate has a pair of rollers mounted therein. The exposed ends of the strings respectively and correspondingly pass through each pair of rollers of the plate members and are controllably held by the same.

BRIEF DESCRIPTION OF THE DRAWINGS

Other features and advantages of the present invention will become apparent in the following detailed description, including drawings, all of which show a non-limiting form of the invention, and of which:

FIG. 3 is a perspective, schematic view of a curtain assembly according to the present invention.

DETAILED DESCRIPTION OF THE PREFERRED EMBODIMENT

Figure 3:
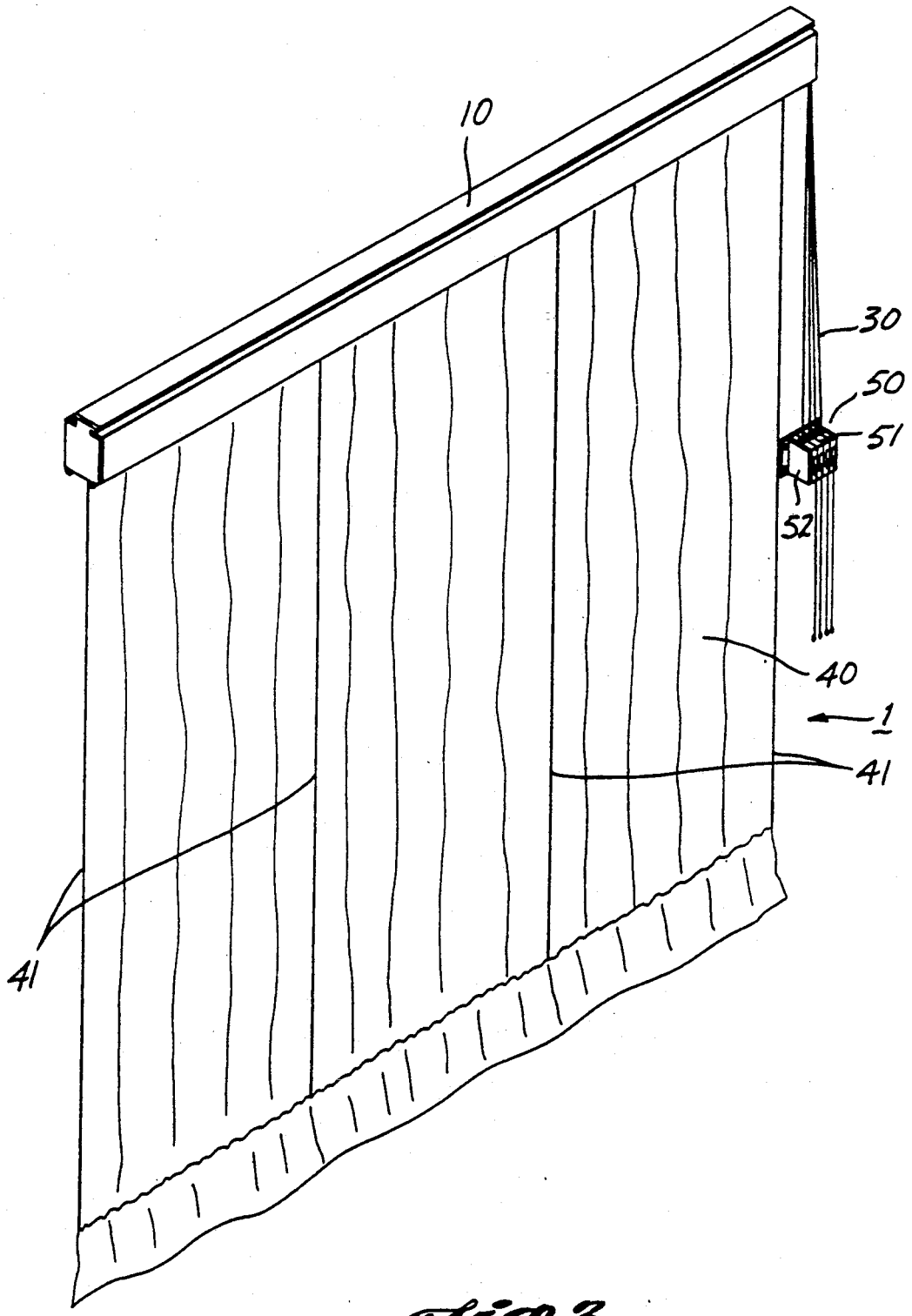
FIG. 3 shows an exploded view of a preferred embodiment of a curtain assembly according to the present invention.

FIG. 3 shows a curtain assembly (1) of the present invention. Accordingly, it includes a curtain (40), an elongated support member (10), a plurality of strings (30), and a string control member (50).

The curtain (40) is generally like the conventional curtain but it has a plurality of strings (41) extending along the height of the curtain. The first end of each string is connected to the bottom edge of the curtain. Thus the curtain can be raised and/or lowered by the strings.

Figure 1:
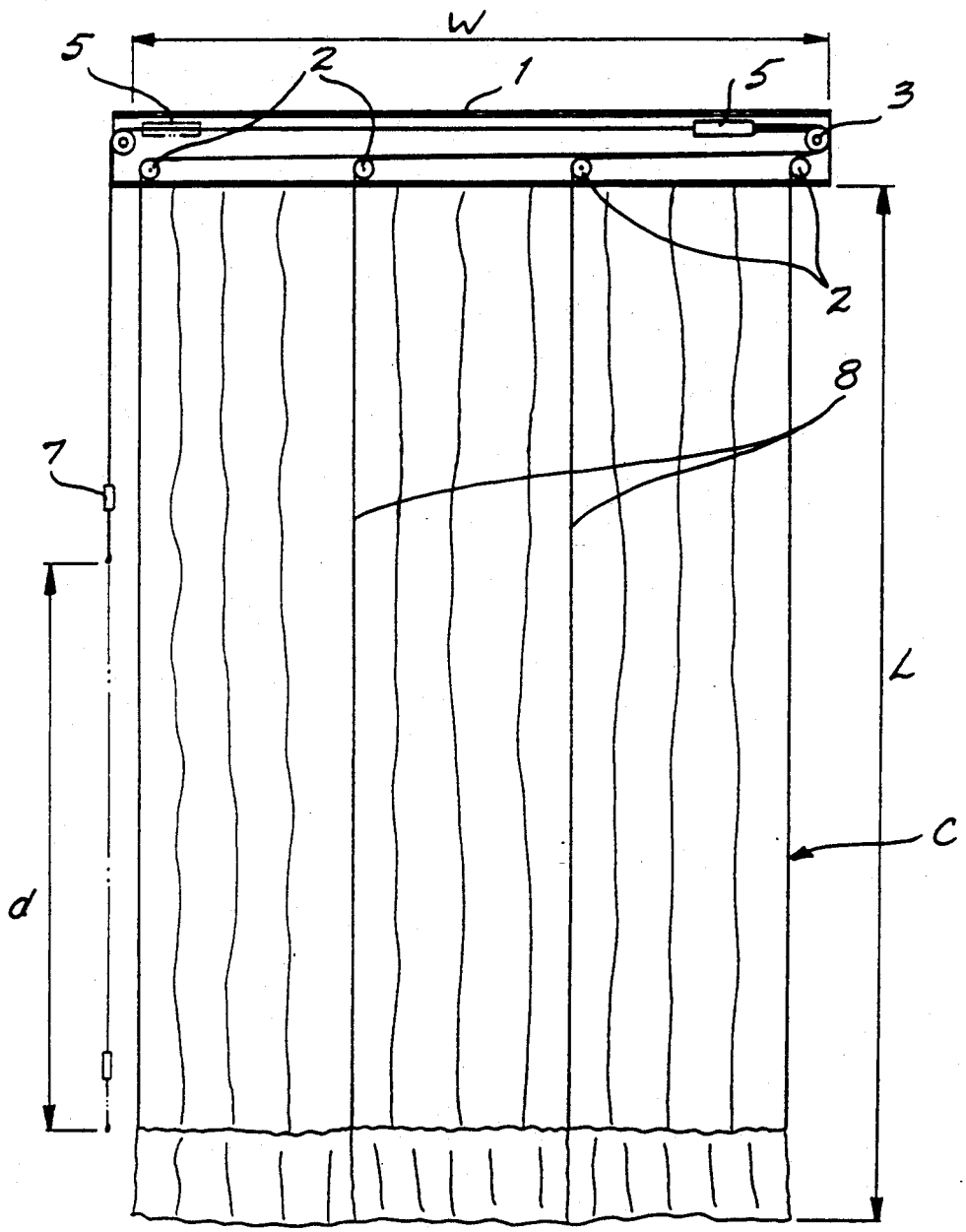
Fig. 1. PRIOR ART
FIG. 1 shows a curtain assembly of the prior art.
Figure 2:
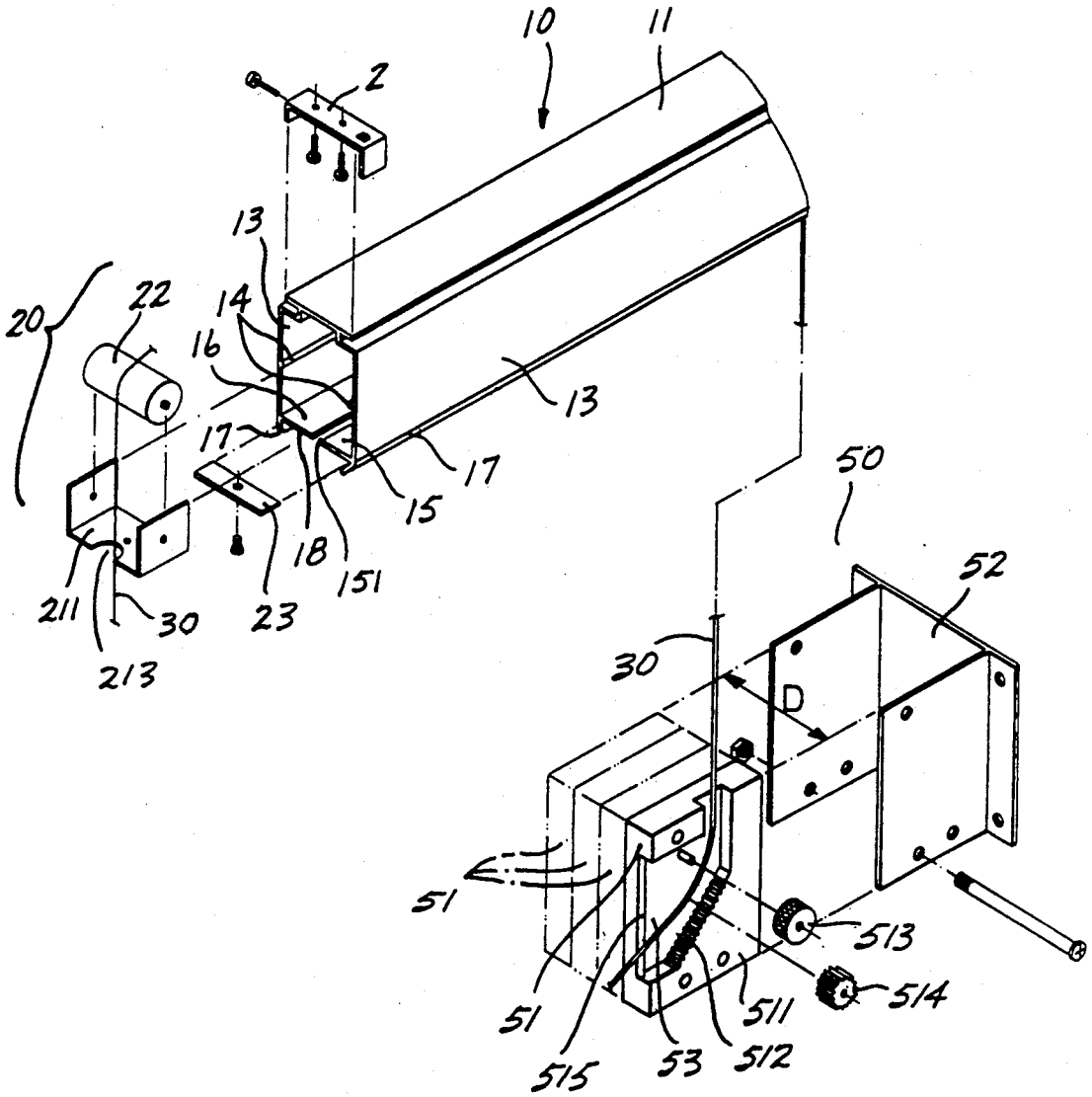
FIG. 2(A), 2(B), and 2(C) show the operations of a curtain assembly of the prior art, shown without the attached curtain.

As shown in FIG. 2, the elongated support member (10) is a rectangular frame with a top wall (11), a bottom wall (15) and two opposed side walls (13). The bottom wall (15) has a slit (151) formed axially therealong. Each of the two opposed side walls (15) has a protrusion (14), which cooperates with the bottom wall to define a guide path (16) between them. A pair of extensions (17) extend inclinedly from both sides, under the bottom wall so as to form a second guide path (18). The top wall (11) of the frame (10) is attached to the upper portion of a window frame by a fixing means (2).

A plurality of first rollers (22), each mounted on a U-shaped frame (21), are inserted into the guiding path (16) and fastened by a screw through a plate member (23) and the slit (151). The plate member (23) is also inserted into the second guide path (18). The base portion (211) of the U-shaped frame (21) has an semicircular opening (213) for allowing a string to pass through. The plurality of first rollers are regularly spaced in the guide path (16).

Figure 4:
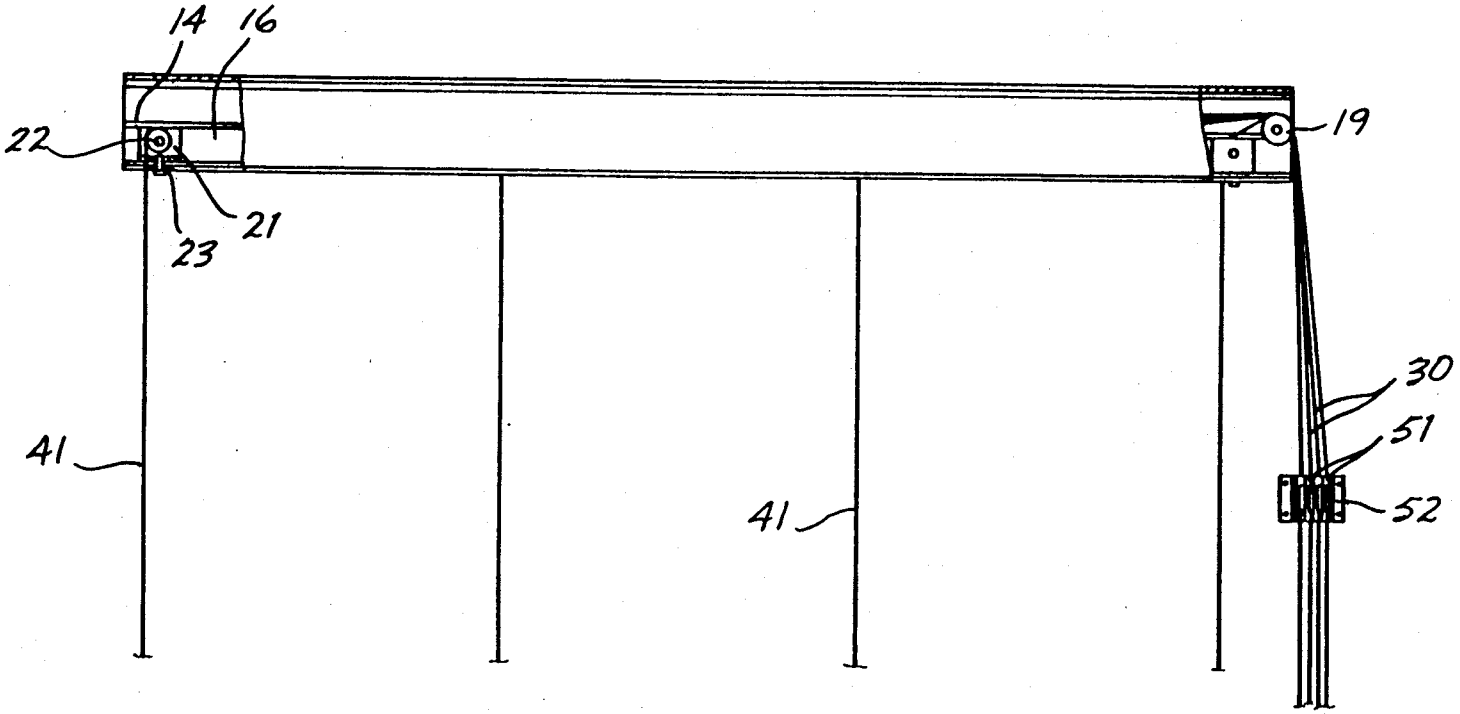
FIG. 4 shows a cross sectional view of the preferred embodiment of a curtain assembly according to the present invention.

A second roller (19) is provided in the elongated support member, adjacent to one end of the same, as shown in FIG. 4. The plurality of strings (41) of the curtain (40) pass over the respective and corresponding first rollers (22) and later the second roller (19) to extend out of the elongated support member (10).

Figure 5:
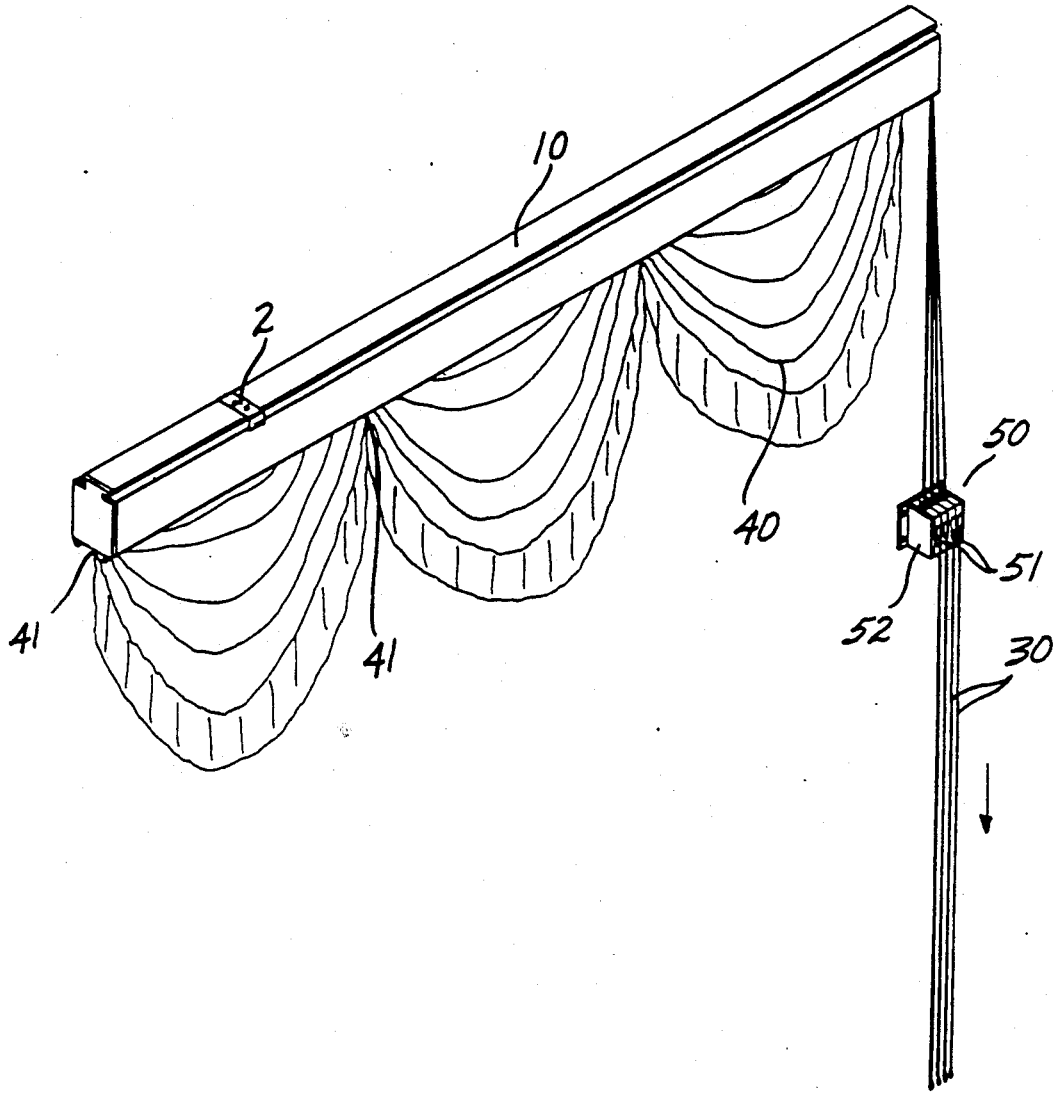
FIG. 5 shows a perspective, schematic view of a curtain assembly of the present invention, showing the curtain being rolled up as a whole.

The string controlling member (50) includes a plurality of plate units (51) which are held together in a substantially U-shaped frame (52). Each of the plate units (51) has a generally square body (511) with a recess (515) therein. Each of the plate units (51) has a row of teeth (512) inclinedly provided in the recess (515) of the body (511) and a third roller (513) rotatably mounted thereon. A fourth roller (514) having teeth extending outward from the periphery of the same, is disposed between the third roller (513) and the row of teeth (512). The teeth are meshed so that each of the extending strings (30) of the curtain (40) can pass through and be releasably held between the rollers (513, 514). The frame (52) is fixed to a wall near the curtain assembly. The strings (30), can each be separately actuated, or they can be operated as a group. When the user desires the curtain (40) to be rolled up all together, he must pull all the strings (30) downward together as indicated by the arrow, in FIG. 5. Then, the whole curtain will rise evenly.

Figure 6:
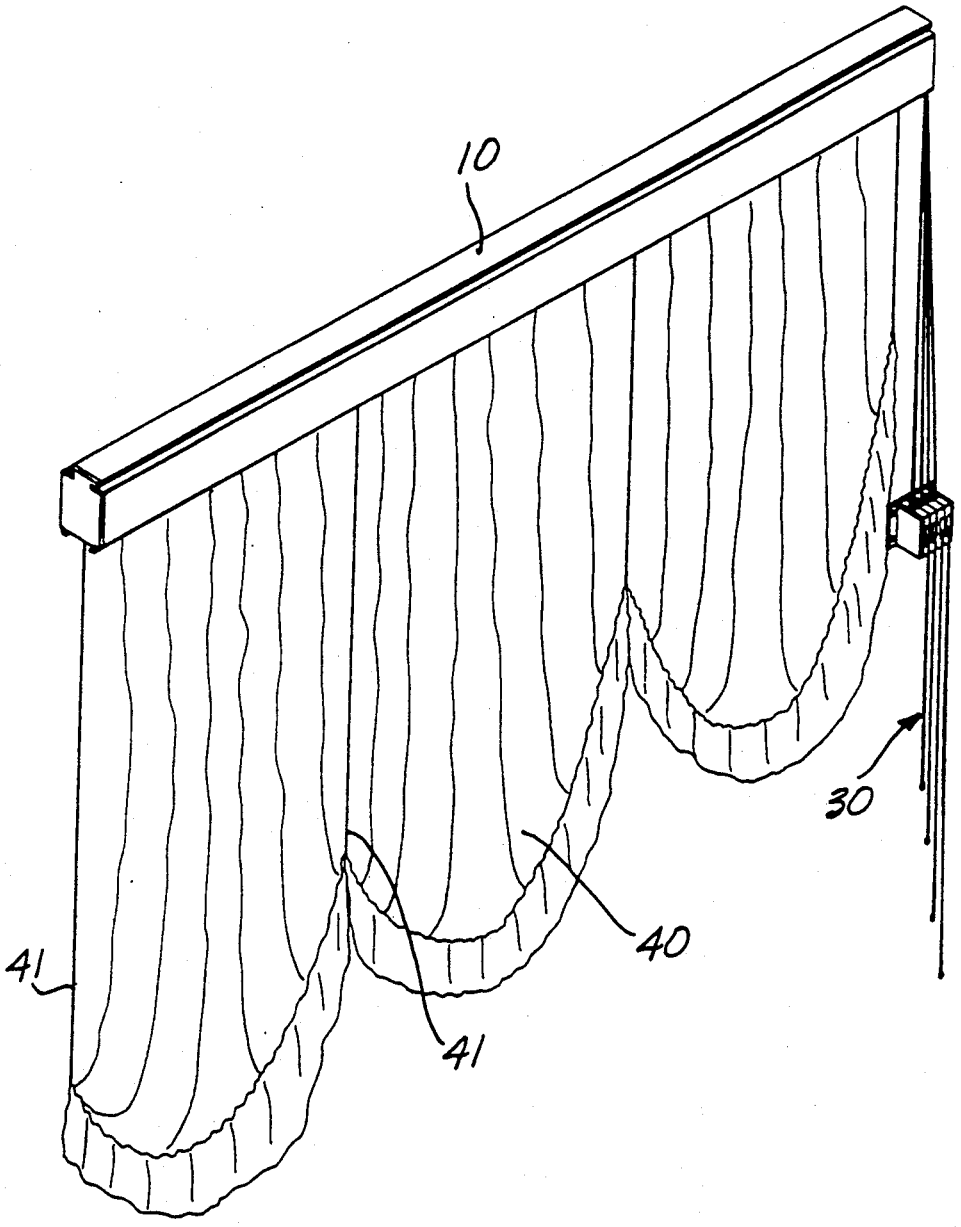
FIG. 6 shows a perspective, schematic view of a curtain assembly of the present invention, showing one portion of the curtain being rolled up higher than other portions of the same.

Sometimes, the user may wish to raise only a portion of the curtain (40). In that case, he needs to pull the corresponding strings downward to raise that particular portion, as shown in FIG. 6. This is the main feature of the present invention. The curtain can be raised and/or lowered partially or wholly according to the user's wishes.

Figure 7:
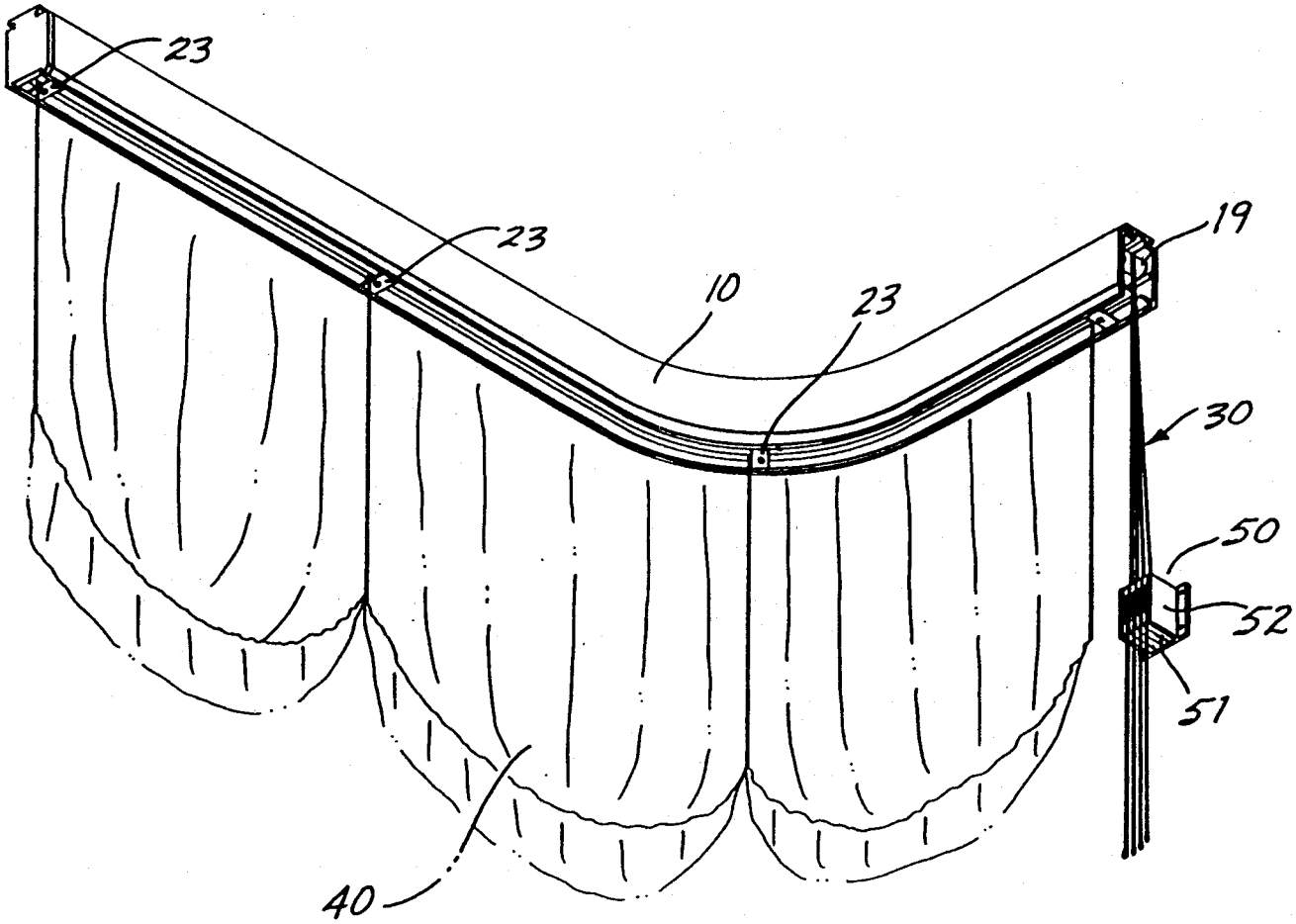

Another feature is that such a curtain assembly can be attached to any window frame, straight or otherwise, since the elongated support member is made of aluminum, which allows substantial bending. In order not to deform the bending portion of the elongated support member (10), a rubber tube is inserted in the support member to flexibly reinforce it. FIG. 7 shows a curtain assembly of the present invention with a bent portion. The curtain (40) is the same as described previously.

With the invention thus explained, it is obvious to those skilled in the art that various modifications and variations can be made without departing from the scope and spirit of the present invention. It is therefore intended that this invention be limited as only indicated in the appended claims.

I claim:

1. A curtain assembly, comprising:

an elongated support member having first and second ends, a top wall, a bottom wall, two opposed side walls, and a guide path defined by said top wall, said bottom wall and said two opposed side walls, said bottom wall having a slit longitudinally formed therealong wherein said elongated support member is a rectangular frame having a pair of longitudinal protrusions, one on each side of said two opposed side walls, said pair of longitudinal protrusions being aligned with each other, said pair of longitudinal protrusions and said bottom wall defining a first guide path between them;

a pair of extension plates extending inclinedly from the underside of said bottom wall so as to form a second guide path;

a plurality of first rollers mounted in said guide path and fixed to said bottom wall;

a second roller mounted in said guide path, adjacent one end of said elongated support member;

a curtain having a top end and a bottom end, said curtain being divided into plural vertical sections and hanging from said bottom wall of said elongated support member;

a plurality of first strings attached to said curtain, extending from said bottom end toward said top end of said curtain, each of said first strings defining a boundary of at least one corresponding vertical section of the curtain;

a plurality of second strings, each having a first end and a second end, said first end of each of said plurality of second strings being respectively connected to a corresponding one of said plurality of first strings at said top end of said curtain;

a string control member comprising a plurality of control units, each control unit being operatively connected to a corresponding one of said plurality of second strings and comprising means for holding and releasing the corresponding second string;

a plurality of U-shaped frames, inserted into said first guide path, each U-shaped frame having two arms and a base portion connecting said two arms, said base portion having a semicircular opening for allowing each of said first ends of said plurality of second strings to pass through;

a plurality of plate members inserted into said second guide path, each cooperating to fasten a corresponding one of said U-shaped frames to said bottom wall; and a substantially U-shaped frame in which said control units are held;

wherein each of said control units is generally square-shaped with a recess therein, a row of inclined teeth is formed in said recess of each control unit, each control unit has a third roller rotatably mounted in said recess of said control unit, and a fourth roller is provided between said third roller and said row of teeth and meshed with them, and wherein each of said second strings is releasably held between said third and said fourth rollers in the corresponding control unit; and wherein a vertical position of a selected vertical section of the curtain may be individually adjusted by operating corresponding first and second strings.

2. A curtain assembly as set forth in claim 1, wherein said fourth roller has teeth extending outwardly from its periphery.

* * * * *

UNITED STATES PATENT AND TRADEMARK OFFICE

CERTIFICATE OF CORRECTION

PATENT NO. : 5,109,908

DATED : May 5, 1992

INVENTOR(S) : C.-H. Chen

It is certified that error appears in the above-identified patent and that said Letters Patent is hereby corrected as shown below:

| COLUMN | LINE | |
|---|---|---|
| 1 | 29 | After "through" insert --first and second-- |
| 1 | 48 | "bottom end," should be --bottom, and-- |
| 2 | 10 | Delete the paragraph: "FIG. 2(A), 2(B), and 2(C) show the operations of a curtain assembly of the prior art, shown without the attached curtain." |
| 2 | 13 | "FIG. 3" should be --FIGURE 2-- |

Signed and Sealed this

Thirteenth Day of July, 1993

*Attest:*

*Attesting Officer*

Michael K. Kirk

MICHAEL K. KIRK

*Acting Commissioner of Patents and Trademarks*